US005136763A

United States Patent [19]

Nugent

[11] Patent Number: 5,136,763

[45] Date of Patent: Aug. 11, 1992

[54] PROCESS FOR THE PRODUCTION OF UNIFORM YARNS VIA REDUCED TENSION-INDUCED SLIPPAGE

[75] Inventor: Ralph W. Nugent, Seaford, Del.

[73] Assignee: E. I. du Pont de Nemours and Company, Wilmington, Del.

[21] Appl. No.: 629,756

[22] Filed: Dec. 18, 1990

[51] Int. Cl.[5] ..... D02J 1/22

[52] U.S. Cl. ..... 28/245; 28/244; 242/47.09

[58] Field of Search ..... 28/245, 244, 240; 242/47.08, 47.09

[56] References Cited

U.S. PATENT DOCUMENTS

| | | | |
|---|---|---|---|
| 2,289,232 | 7/1942 | Babcock | 18/8 |
| 2,413,073 | 12/1946 | Saum | 28/71.3 |
| 2,553,127 | 5/1951 | Barker | 242/47.09 |
| 2,728,973 | 1/1956 | Kummel | 28/71.3 |
| 2,736,944 | 3/1956 | Herbert et al. | 28/244 |
| 3,452,130 | 6/1969 | Pitzl | 264/210 |
| 3,551,550 | 12/1970 | Bauer et al. | 263/290 |
| 3,655,839 | 4/1972 | Sempel et al. | 264/40 |
| 3,752,457 | 8/1973 | Parmeggiani et al. | 264/210 F |
| 3,766,614 | 10/1973 | Coats et al. | 28/244 |
| 3,892,020 | 7/1975 | Koslowski | 28/244 X |
| 3,978,192 | 8/1976 | Sussman | 264/290 N |
| 4,042,662 | 8/1977 | Corbin, Jr. et al. | 264/210 F |
| 4,891,872 | 1/1990 | Sussman | 28/244 |

FOREIGN PATENT DOCUMENTS

| | | | |
|---|---|---|---|
| 514447 | 10/1952 | Belgium | 242/47.09 |
| 81253 | 12/1951 | Czechoslovakia | 28/244 |
| 628569 | 3/1936 | Fed. Rep. of Germany | 28/245 |
| 1236259 | 9/1956 | France | 28/245 |
| 60-065142A | 4/1985 | Japan . | |
| 57925 | 2/1946 | Netherlands | 28/244 |
| 907904 | 4/1961 | United Kingdom . | |
| 934383 | 8/1963 | United Kingdom | 28/244 |

*Primary Examiner*—Werner H. Schroeder
*Assistant Examiner*—Bibhu Mohanty

[57] ABSTRACT

In processes of the production of thermoplastic polymer yarns, a process for controlling slippage of yarn on rolls across which there is a tension change. The yarn is advanced along pairs of rolls with the yarn contacting the rolls in successive wraps. At least one of the rolls is driven and has a changing diameter as the yarn advances between at least two of the successive wraps. The wraps contact the contact areas on the surface of the driven roll to each define a total wrap angle for the wrap. The number of wraps is selected and the diameter of the driven roll at the contact areas is selected to increase or decrease the tension while preventing a wrap angle in creep for any one of the wraps from being greater than about 90% of the total wrap angle for the wrap.

15 Claims, 5 Drawing Sheets

PROCESS FOR THE PRODUCTION OF UNIFORM YARNS VIA REDUCED TENSION-INDUCED SLIPPAGE

BACKGROUND OF THE INVENTION

The present invention relates to processes for the production of thermoplastic polymer yarns and more particularly relates to manufacturing processes which produce highly uniform thermoplastic polymer yarns.

In the production of many synthetic thermoplastic polymer yarns which are melt spun, at least one drawing step is either coupled with or performed as a separate step in the manufacturing process. The drawing of the yarns to impart orientation and thereby reduce residual elongation and increase tensile strength requires, in most cases, that the yarn be subjected to a significant tension.

Usually for such drawing, the yarn is advanced in a draw zone between sets of rotating rolls including feed rolls and subsequent draw rolls which are rotated at a higher peripheral speed than the feed rolls to impart the desired tension on the yarn. However, because the yarn which is advancing to the feed rolls is usually at a much lower tension than the tension in the draw zone, at least some slippage frequently occurs on the feed rolls and sometimes the draw begins to occur on the rolls. It has been discovered that this slippage and the drawing on the feed rolls can cause variations in the yarn and can affect the suitability of the yarns for end use applications such as in fabrics which are dyed with structure sensitive reactive dyes. When such dyes are used, otherwise undetectable variations in the yarns can be responsible for highly visible non-uniformity in fabric dyeing.

It has also been discovered that the decrease in tension across a roll set also can cause a non-uniform yarn to be produced due to slippage. This can occur in a wide variety of yarn processes when the tension on the yarn decreases substantially across a roll set. For example, when the yarn leaves a draw zone in a drawing step, tension is often substantially reduced. Similarly, in extremely high speed spinning process without a draw step in which the yarn is withdrawn from a spinneret at a speed to impart a high degree of spin orientation, the tension on the yarn can be very substantial and can be too high for the winding up of good packages. A tension let-down step may be necessary before windup.

Various techniques are known for preventing slippage on rolls when a tension change is occurring but known techniques generally introduce additional problems. For example, a pinch roll with a softer surface is known for use as disclosed in U.S. Pat. No. 2,413,073 to control tension induced slippage. However, the surface of such pinch roll wears to form grooves and the rolls therefore needs frequent maintenance. While a significant improvement in this apparatus can be obtained by traversing of the thread across the face of the roll and pinch roll contact as disclosed in GB 907,904, a wear problem still exists and the speed of such devices limits their use to only the slowest of processes. The use of aprons or belts to minimize slippage is useful as in Japanese Application No. 60-065,142-A, but great care must be taken to replace the belts when worn to prevent off-quality product.

It is also known to alter slippage by using a draw pin to lower the feed roll tension at the feed roll and isolate the draw at the pin as taught in U.S. Pat. No. 2,289,232. Rotating pins are also known as in U.S. Pat. No. 3,655,839. However, there is the potential for filament breakage and other mechanical damage when such devices are used.

Heated jets are sometimes used to reduce drawing tension and this minimizes tension induced slippage as in U.S. Pat. No. 3,452,130. However, such jets are not suitable for many types of processes and problems in controlling the uniformity of temperature and friction when these hot jets are used makes the process much more difficult to run and more expensive.

The use of snubbing pins to increase pre-tension is a useful route to minimize tension induced slippage as in U.S. Pat. No. 2,728,973 and U.S. Pat. No. 3,752,457 but can sometime also result in filament breakage.

SUMMARY OF THE INVENTION

One aspect of the invention relates to an improved process in which a thermoplastic polymer yarn is drawn by advancing the yarn into a draw zone between feed roll means and at least one subsequent draw roll means rotating at a higher speed than the feed roll means with the yarn undergoing a tension increase of at least a 30% as the yarn is advanced by the feed roll means into the draw zone. The process of the invention includes spirally advancing the yarn, before the yarn enters the draw zone, along a pair of spaced-apart rolls with the yarn contacting the rolls in successive wraps. At least one of the rolls is driven and has a diameter which increases as the yarn proceeds between at least two of the wraps on the pair of rolls. The wraps each contact the surface of the driven roll over a roll contact area to each define a total wrap angle for the wrap. In accordance with the invention, the number of the wraps on the roll and the diameter of the driven roll at each of the contact areas is selected to increase the tension while preventing a wrap angle in creep for any one of the wraps from being greater than about 90% of the total wrap angle for the wrap. In addition, the tension reached in any one of the wraps is prevented from being greater than about 90% of the yarn draw tension of the yarn.

In accordance with a preferred form of the present invention, the number of the wraps on the roll and the diameter of the driven roll at each of the contact areas are selected to increase the tension while preventing a wrap angle in creep for any one of the wraps from being greater than about 80% of the total wrap angle.

In accordance with a preferred embodiment of the present invention, both of the rolls of the pair are driven and both have a diameter which increases as the yarn proceeds between at least two of the wraps.

In accordance with a second aspect of the invention, an improved process is provided in which a thermoplastic polymer yarn is extruded through and withdrawn from a spinneret and subsequently wound up with the tension on the yarn in at least one step of the process being decreased by a tension release zone tension decrease of at least about 20% in a tension release zone prior to windup. The process in accordance with the invention includes spirally advancing the yarn, before the yarn enters the tension release zone, along a pair of spaced-apart rolls with the yarn contacting the rolls in successive wraps. At least one of the rolls is driven and has a diameter which decreases as the yarn proceeds between at least two of the wraps on the pair of rolls. The wraps each contacting the surface of the driven roll over a roll contact area to each define a total wrap angle for the wrap. In accordance with the invention, the number of the wraps on the roll and the diameter of the driven roll at each of the contact areas is selected to decrease the tension while preventing a wrap angle in creep for any one of the wraps from being greater than about 90% of the total wrap angle for the wrap.

In accordance with a preferred form of the present invention, the tension release zone tension decrease is greater than about 30%.

In accordance with a preferred form of the present invention, the number of the wraps on the roll and the diameter of the driven roll at each of the contact areas are selected to decrease the tension while preventing a wrap angle in creep for any one of the wraps from being greater than about 80% of the total wrap angle.

In accordance with a preferred embodiment of the present invention, both of the rolls of the pair are driven and both have a diameter which decreases as the yarn proceeds between at least two of the wraps.

When used in processes for the manufacturing of aliphatic polyamide textile yarns, the invention provides yarns which yield improvements in uniformity which are reflected in the dyeing uniformity of fabrics made from such yarns. The improvements can often be obtained using existing equipment which can be modified for the practice of the present invention.

BRIEF DESCRIPTION OF THE DRAWINGS

The invention and its advantages are best understood from the following detailed description of preferred embodiments when read in conjunction with the accompanying drawings in which.

DETAILED DESCRIPTION

In a process in accordance with the invention, yarn undergoing a tension change is spirally advanced on a pair of rolls with the yarn contacting the rolls in successive wraps. The yarn is prevented from slipping on the roll by providing a tension level change across the roll for each wrap so that slippage does not occur. The invention is applicable to thermoplastic polymer yarn drawing processes in which the yarn enters a draw zone in which the tension increases by at least about 30%. The invention is also applicable to thermoplastic polymer manufacturing processes in which a yarn is withdrawn from a spinneret and undergoes a tension decrease of at least about 20% at some stage in the process. When used for tension decreases, the process is more advantageously practiced when the tension decrease is at least about 30%.

Production processes for thermoplastic polymer yarn for which the invention is useful include processes for making yarns of thermoplastic polymers including, for example, polyamides such as poly(hexamethylene adipamide) and poly(ε-caproamide), polyesters, and polyolefins. The invention is most advantageously practiced with aliphatic polyamides such as poly(hexamethylene adipamide) and poly(ε-caproamide) and their copolymers.

Figure 1:
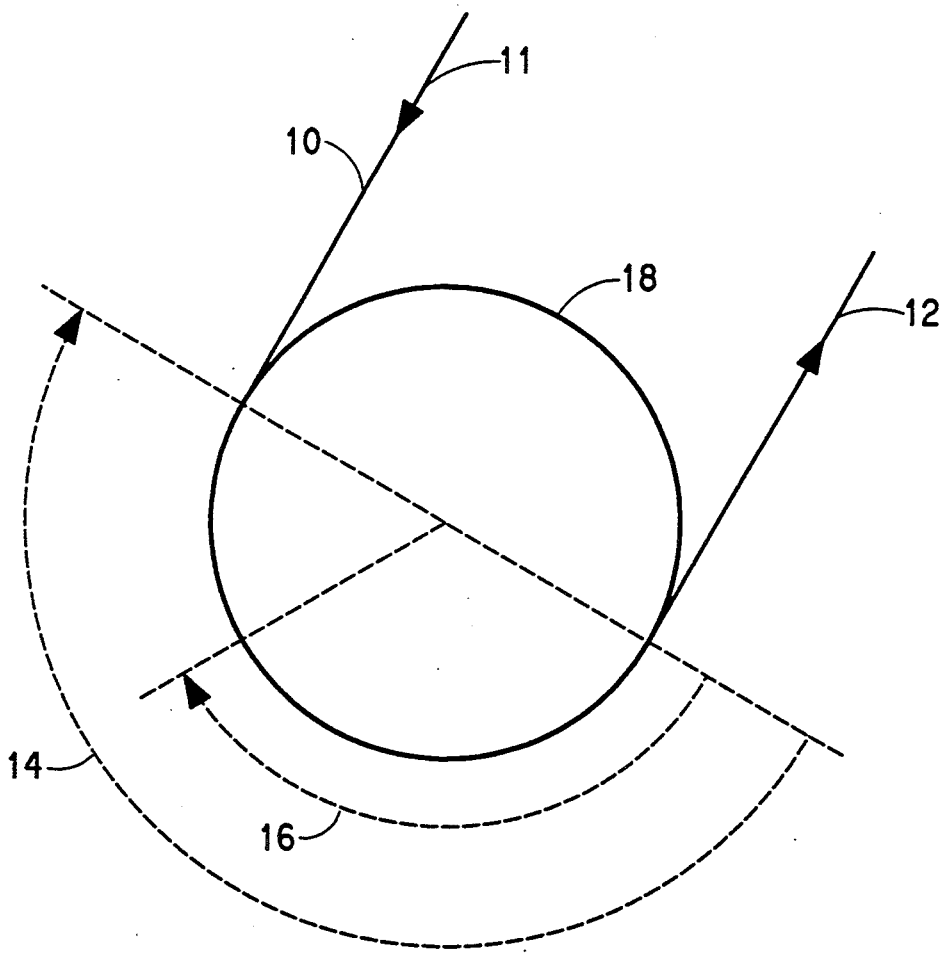
FIG. 1 is a diagrammatical illustration of a wrap of yarn advancing in contact with a roll from a zone of lower tension to a zone of higher tension.

In a process in accordance with the invention, a "wrap angle in creep" for any of the wraps on the roll is prevented from being greater than about 90% of the total wrap angle for the wrap. "Wrap angle in creep" is illustrated in FIG. 1 for a process for increasing tension. The "pulley formula" below describes the tension which will result in a sufficiently high "wrap angle in creep" to cause slippage on the rolls:

$$T_{(H)}/T_{(L)}=e^{uB}$$

wherein $T_{(H)}$ is the higher tension;

$T_{(L)}$ is the lower tension;

e is 2.71;

u is the active coefficient of friction; and

B is the wrap angle in creep in radians.

As may be understood from the pulley formula, the invention provides that at least some portion of the yarn remains in non-slipping contact with the roll if the tension ratio is kept low enough. FIG. 1. illustrates a roll 18 and a single wrap of yarn 11 in contact with a contact area of the roll 18 over total wrap angle 14. Before the wrap, the yarn at 10 is under lower tension $T_{(L)}$ and the yarn at 12 after the wrap is under higher tension $T_{(H)}$. The pulley formula above indicates the wrap angle in creep 16 over which the yarn is in creep or slip. Thus, whether there is a tension increase or decrease, the invention calls for changing the yarn tension level gradually wrap to wrap, taking care to prevent the wrap angle in creep from being greater than about 90% of the total wrap angle. Preferably, the wrap angle in creep is prevented for being greater than about 80% of the total wrap angle.

In accordance with the invention, the wrap angle in creep, is prevented from being greater than 90% of the total wrap angle, by employing a suitable speed difference to set the tension change ratio. This is accomplished by changes in diameter of the rolls along their length. The difference in diameter of the contact areas of the rolls from wrap to wrap is carefully selected taking into consideration the active modulus of the incoming yarn. For aliphatic polyamide yarns this usually amounts to about 1% diameter change per wrap if the total wrap angle is about 180 degrees (3.14 . . . radians). However, it is usually best to determine the diameter change empirically for an actual process.

In a process in accordance with the invention in which tension is increased, the tension is also kept below 90% of the draw tension of the yarn, i.e., the tension required to initiate draw. Otherwise, slippage will occur on the roll due to drawing. Usually, the last wrap on a driven roll before leaving a roll pair is the only wrap where draw tension must be taken into consideration.

Significant physical uniformity improvements and therefore more uniform dyeings of fabrics with structure sensitive reactive dyes are provided by this invention. The nylon yarns produced using the invention show reduced streak levels when used for the production of commercial knit and woven fabrics.

Figure 2:
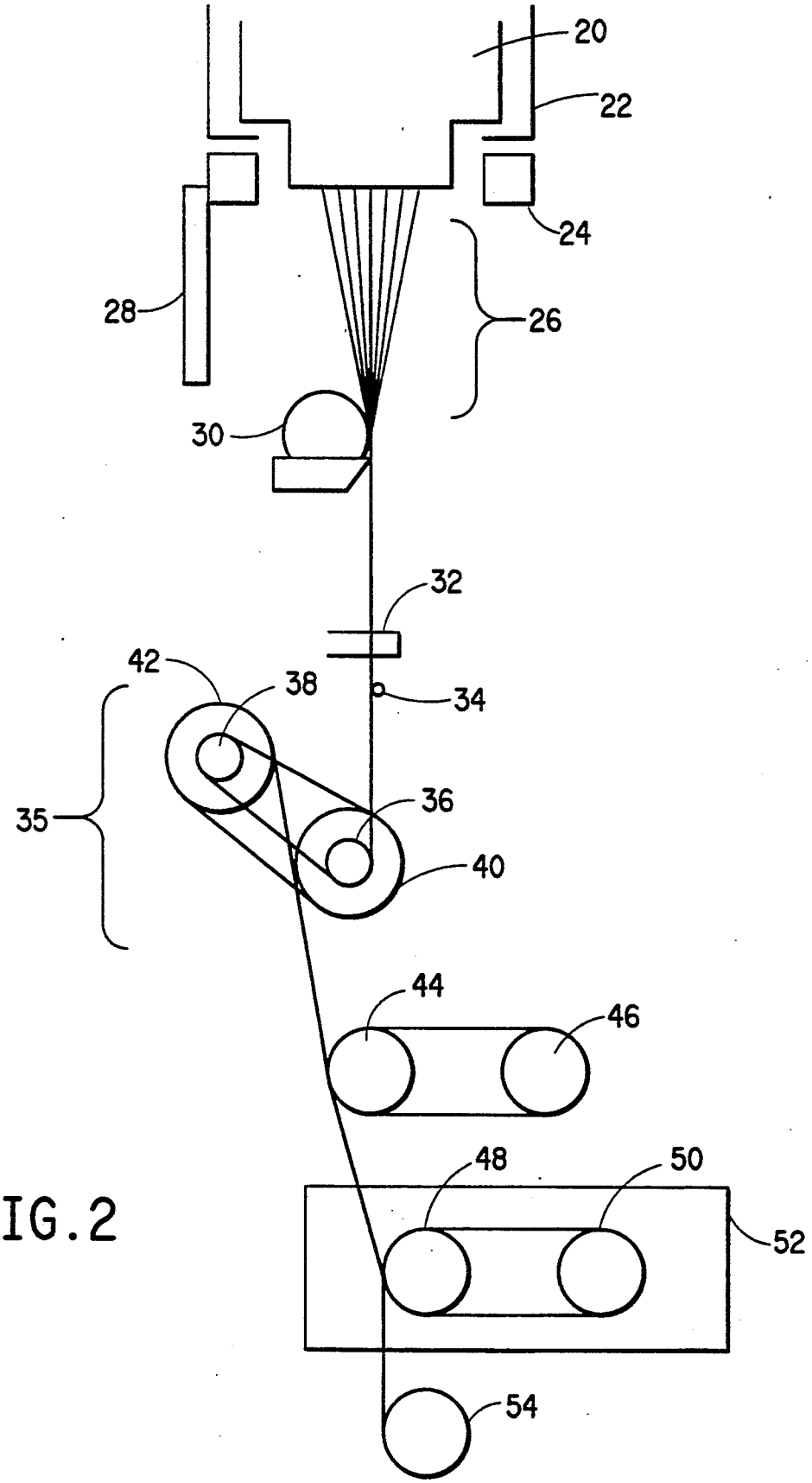
FIG. 2 is a diagrammatical, elevational view of typical nylon fiber coupled spin-draw process employing one form of the process of the present invention for increasing tension in advance of a draw zone.

The invention will be more fully understood when viewed as part of a total spin-draw process shown schematically in FIG. 2. FIG. 2 illustrates the overall process from the spin pack 20 in the spinning head 22 and upper quench zone 24 from which the extruded filaments 26 are quenched by an air flow system 28. The cooled yarn is treated with a spin finish by an applicator 30 before being guided by pins 32 and 34 to a tension increase roll assembly 35. The tension increase roll assembly in the preferred embodiment depicted is a pair of spaced-apart rolls, at least one of the rolls being driven and having contact areas with diameters which increase as the yarn proceeds between at least two of the wraps. As illustrated in FIG. 2, it is most preferable for both of the rolls of the pair to be driven and both have a diameter which increases as the yarn proceeds between at least two of the wraps on the rolls. In the embodiment depicted in FIG. 2, the pair of rolls has roll contact areas 36, 38, 40 and 42 with contact areas 36 and 40 on one driven roll and contact areas 38 and 42 on the other driven roll. Additional contact areas may be provided to provide the tension increase desired without the wrap angle in creep exceeding 90% of the total wrap angle for any one wrap.

Figure 3B:
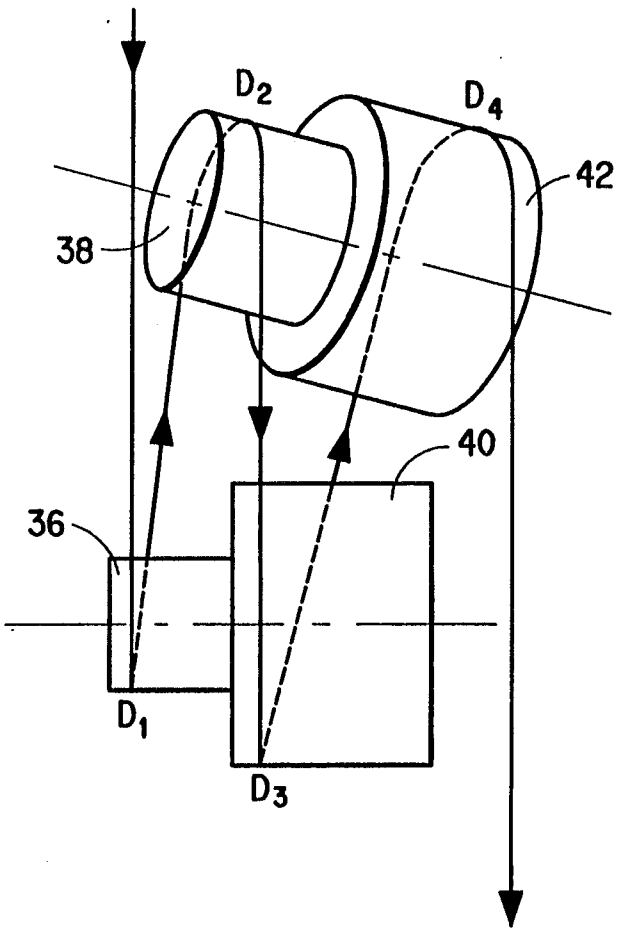
FIGS. 3*a* and 3*b* are enlarged elevational and perspective views, respectively, of apparatus useful for the practice of one form of the present invention for increasing tension in advance of a draw zone.
Figure 3A:
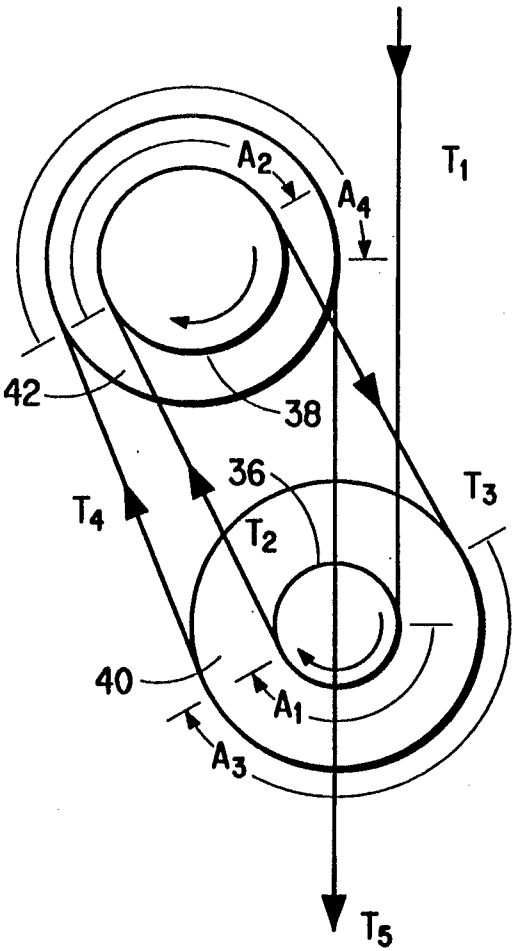

FIGS. 3*a* and 3*b* are elevational and perspective views, respectively, of the tension increasing roll assembly 35 in FIG. 2. In FIG. 3*a*. the tensions for each wrap on roll contact areas 36, 38, 40 and 42 are indicated as $T_1$ and $T_2$ for roll contact area 36; $T_2$ and $T_3$ for roll contact area 38; $T_3$ and $T_4$ for roll contact area 40; and $T_4$ and $T_5$ for roll contact area 42. These tensions $T_1$ through $T_5$ build incrementally with each wrap angle of the roll assembly indicated as $A_1$ for roll contact area 36, $A_2$ for roll contact area 38, $A_3$ for roll contact area 40 and $A_4$ for roll contact area 42. In FIG. 3*b* the stepwise diameter change from roll contact area 36 to 38 to 40 and to 42 is shown. As described in more detail for a preferred embodiment in Example 1 which follows, the diameters of the roll contact areas 36 to 42 increase as: $D_1<D_2<D_3<D_4$. It is preferable for the contact areas to be polished cylindrical surfaces.

The first draw occurs in the space between roll contact area 42 and the first draw roll 44. The first draw system contains one or more wraps around rolls 44 and 46. This first draw roll system is usually not heated but may be optionally so. A second draw or relaxation zone occurs in space between first draw roll 44 and second draw roll 48. The multiple wraps on rolls 48 and 50 can and usually are heated in a containment unit 52 before packaging the product on wind-up 54. Other process elements to enhance the product are usually placed between various of the elements to customize the product. One of the driven rolls of the tension increasing roll assembly 35, first or second stage draw pairs could be replaced by a series of one or more idler rolls.

Figure 5:
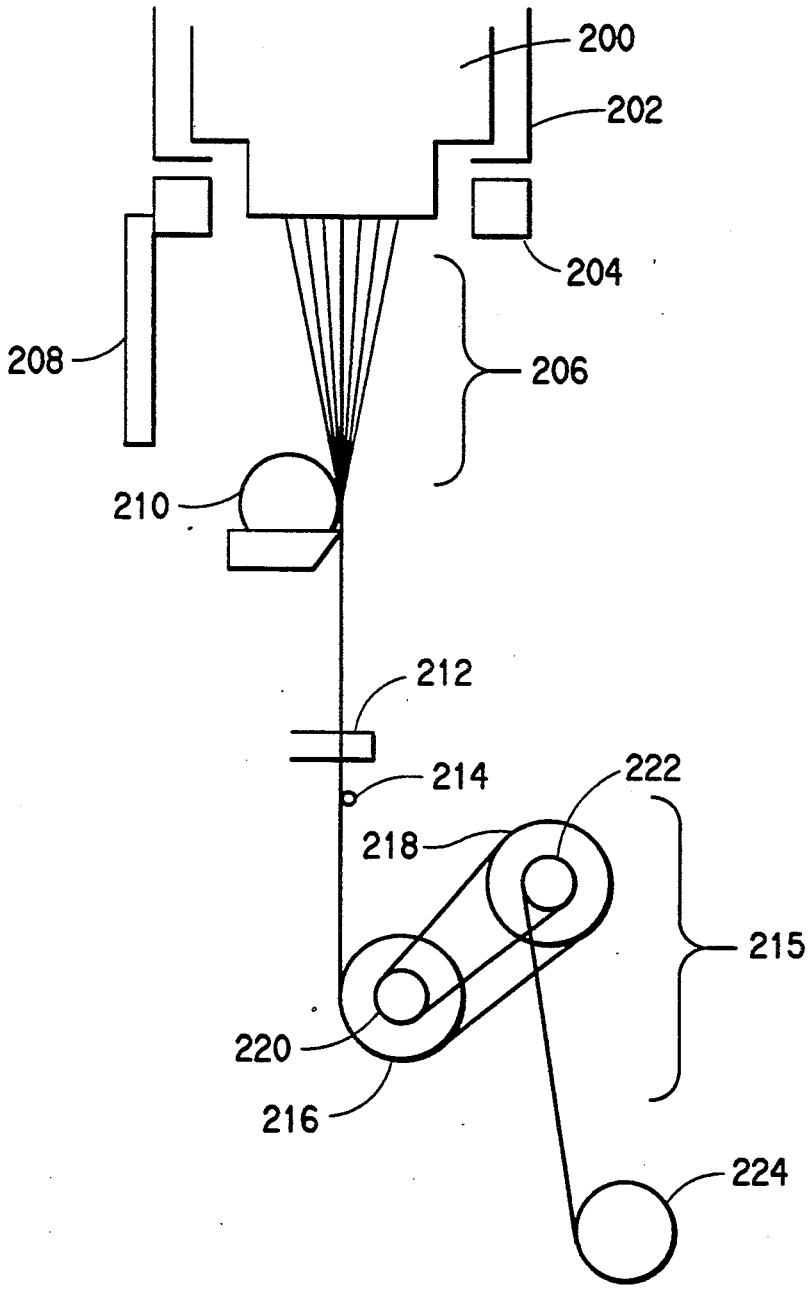
FIG. 5 is a diagrammatical, elevational view of a typical high-speed spinning process for the manufacture of polyester yarn illustrating the use of a process in accordance with the invention for decreasing tension before the yarn is wound up.

The invention as applied to the reduction of slippage during tension reduction in high speed spinning can be more fully understood by reference to the yarn high speed spinning process illustrated in FIG. 5. FIG. 5 illustrates the overall process from the spin pack 200 in the spinning head 202 and upper quench zone 204 from which the extruded filaments 206 are quenched by an air flow system 208. The cooled yarn is treated with a spin finish by an applicator 210 before being guided by pins 212 and 214 to a tension decreasing roll assembly 215 in accordance with the invention.

The tension decreasing roll assembly 215 includes a pair of spaced-apart rolls on which the yarn is spirally advanced. At least one of the rolls is driven and has contact areas with diameters which decreases as said yarn proceeds between at least two of the wraps on the pair of rolls. Preferably, both rolls are driven and both have contact areas with diameters which decrease as the yarn proceeds between wraps. In the preferred embodiment depicted, roll contact areas 216 and 220 are provided on one driven roll and roll contact area 218 and 222 are provided on a second driven roll. Additional contact areas may be required as the tension decrease across any of the wraps must be kept below the 90% of the total wrap angle as given by the pulley formula cited above.

Figure 4B:
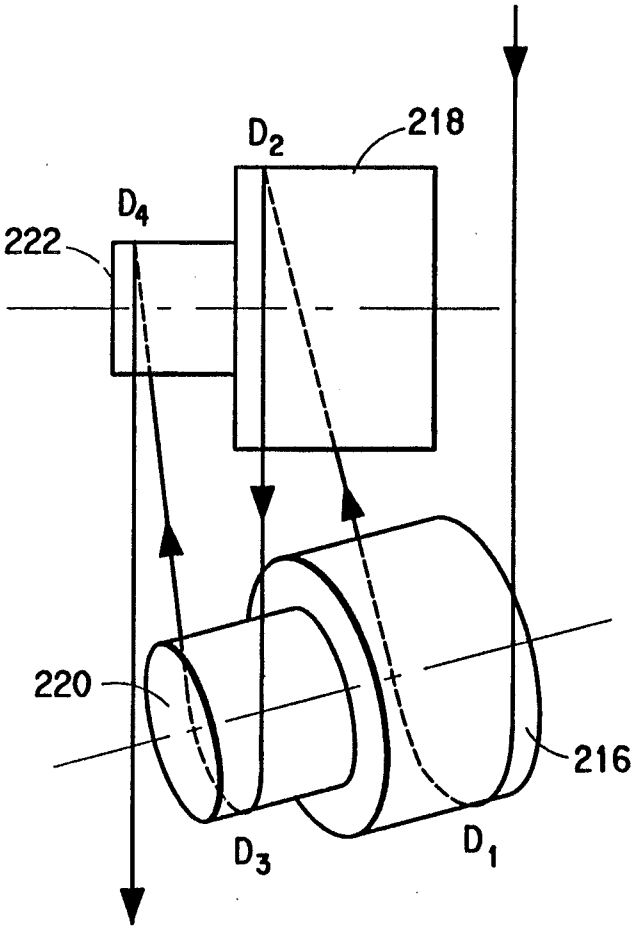
FIGS. 4*a* and 4*b* are enlarged elevational and perspective views, respectively, of apparatus useful for the practice of one form of the present invention for decreasing tension.
Figure 4A:
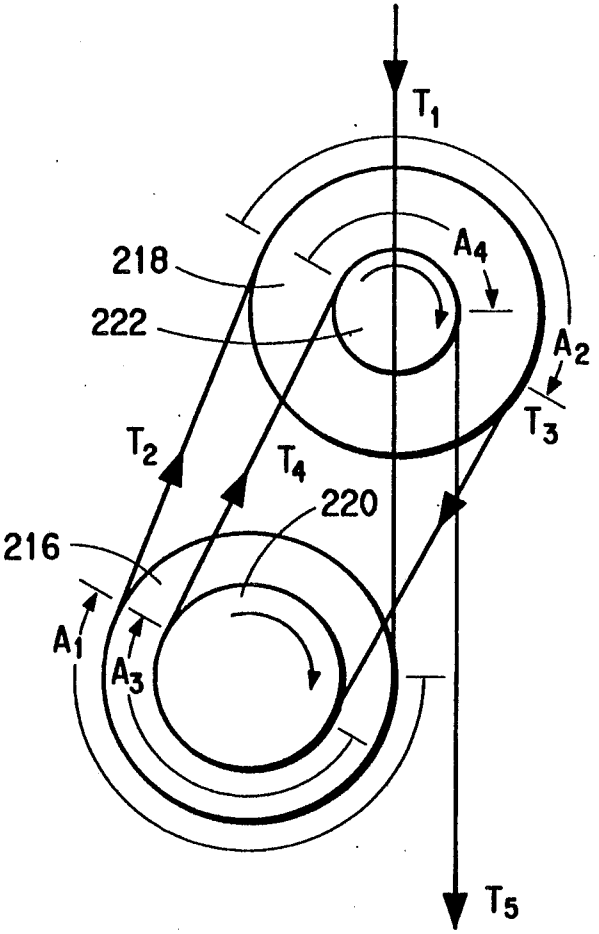

FIGS. 4*a* and 4*b* are elevational and perspective views respectively of the tension decreasing roll assembly 215 in FIG. 5. In FIG. 4*a* the tensions for each wrap on roll contact areas 216, 218, 220 and 222 are indicated as $T_1$ and $T_2$ for roll contact area 216; $T_2$ and $T_3$ for roll contact area 218; $T_3$ and $T_4$ for roll contact area 220; and $T_4$ and $T_5$ for roll contact area 222. These tensions $T_1$ through $T_5$ decrease incrementally with each wrap angle of the roll assembly indicated as $A_1$ for roll contact area 216, $A_2$ for roll contact area 218, $A_3$ for roll contact area 220 and $A_4$ for roll contact area 222. In FIG. 4*b*. the stepwise diameter change from roll contact area 216 to 218 to 220 and to 222 is shown. The diameters of the rolls 216 to 222 decrease as: $D_1>D_3>D_3>D_4$. It is preferable for the contact areas of the rolls of the tension decreasing assembly to be cylindrical surfaces with a low coefficient of friction.

The packaging of the product occurs on windup 224. Other process elements to enhance the product are usually placed between the various elements to customize the product. One of the driven rolls of the tension decreasing roll assembly 215 could be replaced by a series of one or more idler rolls.

The process illustrated in FIG. 5 is particularly useful for polyester yarn spun with a withdrawal speed from the spinneret of at least about 3000 meters per minute (mpm) and for aliphatic polyamides when spun at a withdrawal speed of at least about 4000 mpm since the tension in the spinning zone is usually too high for a good wind-up. The process of the invention is also advantageously employed for tension decreases occurring when yarn leaves a draw zone in which the yarn is drawn by advancing the yarn between feed rolls and at least one set of subsequent draw rolls rotating at a higher speed. Most preferably in such a process with a draw stage, rolls as depicted in FIGS. 4*a* and 4*b* with a suitable number of roll contact areas are used to replace the draw rolls.

Another use for the invention is to adjust tension in high speed spinning processes for the purposes of introducing interlace. A tension decreasing roll assembly as in FIG. 5 and FIGS. 4*a* and 4*b* can be used to step down tension to a suitable level for interlacing. Then, a tension increasing roll assembly as in FIGS. 3*a* and 3*b* can be used to step the tension back up to a suitable level for wind-up. Alternately, the tension decrease and subsequent increase can be done using one set of rolls with a single drive with roll contact areas appropriate to achieve step down and step up. The interlace apparatus can be suitably positioned between the rolls.

EXAMPLE 1

In this example, apparatus as illustrated in FIGS. 2, 3*a* and 3*b* is used for preparing poly(hexamethylene adipamide) (nylon 66) using spin draw apparatus employing a process according to the invention.

A 34 filament capillary spinneret with 0.2286 millimeter by 0.3048 millimeter (0.009 inch by 0.012 inch) capillaries is used to spin a (hexamethylene adipamide) yarn. The spun yarn is advanced to roll contact area 36 of tension increasing roll assembly 35 which has an initial diameter of 11.43 centimeters (4.500 inches) before wrapping the slightly larger diameter of roll contact area 38 before returning to yet larger diameter contact area 40 and so onto roll contact area 42. Cant and skew angles are held to a minimum to improve thread line stability. The surface of the driven rolls is polished chrome plate. A conventional spin finish is applied to the spun filaments 26 by applicator 30 at a level of 0.2 to 1.0% oil on yarn. The 332 yarn denier when run 719 meters per minute at roll contact area 36 develops a very low spun tension level of 6 grams. This is less than 0.02 grams per denier pre-feed tension which would normally require the use of snubbing pins to control the process. In Table 1 below, the first column refers to the wrap on each succeedingly larger diameter of the stepped roll. FIGS. 3*a* and 3*b* show how the feed rolls increase in diameter and are wrapped with the identified wrap angles on diameters D1 through D4.

TABLE 1

| Wrap No. ON DIA | Total wrap rad. $A_{(n)}$ | Creep wrap rad. $B_{(n)}$ | % of angle in creep | Tens. high $T_{(H)}$ | Tens. Low $T_{(L)}$ | empirical coefficient friction u | Dia. Incr. to next. |
|---|---|---|---|---|---|---|---|
| D1 | 2.61 | 1.89 | 85% | 10.8 | 6.0 | (0.31) | — |
| D2 | 3.48 | 2.54 | 72% | 23.8 | 10.8 | (0.31) | 0.9% |
| D3 | 1.74 | 1.47 | 85% | 37.5 | 23.8 | (0.31) | 1.1% |
| D4 | 3.14 | 2.34 | 75% | 77 | 37.5 | (0.31) | 0.8% |

The active coefficient of friction is determined to be 0.31 based on results of making nylon yarn using the same process as described above using straight rolls as described in Table 2 below instead of the tension increasing roll assembly 35 described above. The roll surfaces in all cases are approximately 4–7AA polished chrome.

TABLE 2

| Wrap No. | Total wrap rad. $A_{(n)}$ | Creep wrap rad. $B_{(n)}$ | % of angle in creep | Tens. high $T_{(H)}$ | Tens. Low $T_{(L)}$ | empirical coefficient friction u | Dia. Incr. to next. |
|---|---|---|---|---|---|---|---|
| D1 | 2.61 | 1.64 | 62% | 10 | 6 | (0.31) | — |
| D2 | 3.48 | 3.48 | 100% | 29 | 10 | (0.31) | 0.0 |
| D3 | 3.14 | 3.14 | 100% | 77 | 29 | (0.31) | 0.0 |

When the yarn produced in accordance with the invention is knit into plain jersey tricot fabric, the fabric lays much flatter than yarn produced using the straight rolls and visible configuration improvement is noted on the float side of the fabric with a portable light held so as to illuminate the fabric from a low angle. In spinning, the yarn stability on the preferred tension increase roll assembly is very much improved and the yarn defects detected in knitting and beaming are very much reduced. However the main improvement noted is in fabrics made from the yarns when dyed with reactive dyes, particularly large molecule reactive dyes. In Table 3 below, fabric rating results were determined using the computer generated streak rating series available from the American Association of Textile Chemists and Colorists. P.O. Box 12215, Research Triangle Park, N.C. 27709 with 1.0 indicating the worst streaks and 10.0 indicating no streaks. Fabrics were rated on the float side of the fabric.

TABLE 3

| Fabric Dye System | | Preferred Apparatus | Comparison Apparatus | Impr. Delta |
|---|---|---|---|---|
| Disperse Blue 3 @ 98 C. 1.5 hr | 9.0 Ph | 8.5 | 8.0 | +0.5 |
| 2.0% Acid Blue 45 @ 98 C. 1 hr | 5.8 Ph | 8.0 | 7.0 | +1.0 |
| 1.0% Blue 122 @ 98 C. 0.5 hr | 5.0 Ph | 4.5 | 3.5 | +1.0 |
| 1.0% Blue 122 (Merpol DA) @ 98 C. 0.5 hr | 6.0 Ph | 5.0 | 4.0 | +1.0 |
| 0.75% Irgalan Black 131 (Merpol DA) @ 98 C. 0.5 hr | 6.0 Ph | 5.0 | 3.0 | +2.0 |
| 0.75% Irgalan Black 131 @ 98 C. 0.5 hr | 5.0 Ph | 3.5 | 2.0 | +1.5 |

EXAMPLE 2

In this example, apparatus for high speed spinning is illustrated in FIGS. 4*a*, *rb* and 5 for use in the high speed spinning of polyester at over 5000 mpm employing a process according to the invention. Using apparatus illustrated at that speed using a pair of conventional straight rolls instead of the tension release roll system will result in a sufficient tension that packaging of the yarn would be poor.

A 34 filament capillary spinneret with 0.2286 millimeter of 0.3048 millimeter (0.009 inch by 0.0012 inch) capillaries is used to high speed spin a 70 denier polyester yarn. The spun yarn is advanced to roll of tension decreasing roll assembly 215 as depicted in FIGS. 4*a* and 4*b* except that there are six roll contact areas incrementally decreasing in diameter instead of 4. Contact area 216 of the assembly 215 has an initial diameter of 15.24 centimeters (6.0 inches) and then contacts roll contact area 218 and back to contact area 220 and so on through the six decreasing diameters as indicated in Table 4 below. Cant and skew angles are held to a minimum to improve threadline stability. The surface of the driven rolls are low friction. A conventional spin finish is applied to the spun filaments 4 by applicator 6. The tension values and the coefficient of friction reported in table 4 are based on data from a process using conventional straight rolls.

TABLE 4

| Wrap No. ON DIA | Total wrap rad. $A_{(n)}$ | Creep wrap rad. $B_{(n)}$ | % of angle in creep | Tens. high $T_{(H)}$ | Tens. Low $T_{(L)}$ | Empirical coefficient friction u | Dia. decr. to next. |
|---|---|---|---|---|---|---|---|
| D1 | 3.02 | 2.56 | 85% | 48.0 | 38.5 | (0.086) | — |
| D2 | 3.14 | 2.56 | 82% | 38.5 | 30.5 | (0.086) | 0.25% |
| D3 | 3.14 | 2.55 | 81% | 30.5 | 24.5 | (0.086) | 0.26% |
| D4 | 3.14 | 2.59 | 83% | 24.5 | 19.6 | (0.086) | 0.25% |
| D5 | 3.14 | 2.72 | 87% | 19.6 | 15.5 | (0.086) | 0.26% |
| D6 | 3.26 | 2.78 | 85% | 15.5 | 12.2 | (0.086) | 0.25% |

While preferred embodiments have been shown and described in the foregoing detailed description, it will be understood that the invention is capable of numerous modifications, rearrangements and substitution of parts without departing from the spirit of the invention as set forth in the appended claims.

I claim:

1. A process for thermoplastic polymer yarn drawing in which a yarn is drawn by advancing the yarn into a draw zone between feed roll means and at least one subsequent draw roll means rotating at a higher speed than said feed roll means, said yarn undergoing a pre-draw zone tension increase of at least 30% as said yarn is advanced by said feed roll means into said draw zone, the improvement which comprises:

spirally advancing said yarn, before said yarn enters said pre-draw zone, in successive wraps along a pair of spaced-apart rolls, at least one of said rolls being driven and having a diameter which increases as said yarn proceeds between at least two of said wraps on said pair of rolls, said wraps each contacting said surface of said driven roll over a roll contact area to each define a total wrap angle for said contact area, the number of said wraps on said roll and said diameter of said driven roll at each of said contact area being selected to increase said tension while preventing a wrap angle in creep for any one of said contact areas from being greater than about 90% of said total wrap angle for said wrap and while preventing the tension in any one of said wraps from being greater than about 90% of the yarn draw tension of said yarn.

2. The process of claim 1 wherein the number of said wraps on said roll and said diameter of said driven roll at each of said contact areas being selected to increase said tension while preventing a wrap angle in creep for any one of said wraps from being greater than about 80% of said total wrap angle.

3. The process of claim 1 wherein both of said rolls of said pair are driven and both have a diameter which increases as said yarn proceeds between at least two of said wraps.

4. The process of claim 3 wherein the diameter of each of said driven rolls is such that the tension increases in increments over each of said wraps.

5. The process of claim 1 wherein said pair of rolls is said feed rolls means.

6. The process of claim 1 wherein said yarn is an aliphatic polyamide yarn.

7. A process in which a thermoplastic polymer yarn is extruded through and withdrawn from a spinneret and subsequently wound up, the tension on said yarn in t least one step of said process being decreased by a tension release zone tension decrease of at least about 20% in a tension release zone prior to windup, the improvement which comprises:

spirally advancing said yarn, before said yarn enters said tension release zone, in successive wraps along a pair of spaced-apart rolls, at least one of said rolls being driven and having a diameter which decreases as said yarn proceeds between at least two of said wraps on said pair of rolls, said wraps each contacting said surface of said driven roll over a roll contact area to each define a total wrap angle for said contact area, the number of said wraps on said roll and said diameter of said driven roll at each of said contact areas being selected to decrease said tension while preventing a wrap angle in creep for any one of said contact areas from being greater than about 90% of said total wrap angle for said wrap.

8. The process of claim 7 wherein said tension release zone tension decrease is greater than about 30%.

9. The process of claim 7 wherein said tension release zone tension decrease occurs after said yarn leaves a draw zone in which said yarn is drawn by advancing the yarn between feed roll means and at least one subsequent draw roll means rotating at a higher speed than said feed roll means.

10. The process of claim 9 wherein said pair of rolls is said draw roll means.

11. The process of claim 7 wherein said yarn is a polyester yarn and said yarn is withdrawn from the spinneret at a withdrawal speed of at least about 3000 mpm.

12. The process of claim 7 wherein said yarn is an aliphatic polyamide yarn and said yarn is withdrawn from the spinneret at a withdrawal speed of at least about 4000 mpm.

13. The process of claim 7 wherein said number of wraps and the diameter of said rolls at said contact areas are selected to decrease said tension while preventing a wrap angle in creep for any one of said wraps from being greater than about 80% of said total wrap angle for said wrap.

14. The process of claim 7 wherein both of said rolls of said pair are driven and both have a diameter which decreases as said yarn proceeds between at least two of said wraps.

15. The process of claim 14 wherein the diameter of both of said driven rolls is such that the tension decreases in increments over each of said contact areas.

* * * * *